US011980788B1

(12) United States Patent
Maresh

(10) Patent No.: US 11,980,788 B1
(45) Date of Patent: May 14, 2024

(54) INERTIAL RESISTANCE EXERCISE APPARATUS

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 48 days.

(21) Appl. No.: 17/494,779

(22) Filed: Oct. 5, 2021

Related U.S. Application Data

(60) Provisional application No. 63/205,087, filed on Nov. 17, 2020.

(51) Int. Cl.

| | |
|---|---|
| ***A63B 22/06*** | (2006.01) |
| ***A63B 21/00*** | (2006.01) |
| ***A63B 21/06*** | (2006.01) |
| ***A63B 23/035*** | (2006.01) |

(52) U.S. Cl.
CPC ..... *A63B 22/0664* (2013.01); *A63B 21/0615* (2013.01); *A63B 21/15* (2013.01); *A63B 23/03533* (2013.01)

(58) Field of Classification Search
CPC . A63B 21/0615; A63B 21/15; A63B 22/0664; A63B 22/04; A63B 22/06; A63B 22/0605; A63B 22/0694; A63B 23/03533; A63B 2022/067; A63B 2022/0676; A63B 2022/0682; A63B 2022/0688
See application file for complete search history.

(56) References Cited

U.S. PATENT DOCUMENTS

| | | | | |
|---|---|---|---|---|
| 5,039,088 | A * | 8/1991 | Shifferaw | A63B 22/001 482/118 |
| 7,846,073 | B2 * | 12/2010 | Summers | A63B 23/03541 482/79 |
| 10,272,286 | B2 * | 4/2019 | Liao Lai | A63B 22/04 |
| 10,596,407 | B1 * | 3/2020 | Maresh | A63B 24/0062 |
| 10,765,912 | B2 * | 9/2020 | Summers | A63B 23/03541 |
| 10,792,536 | B2 * | 10/2020 | Liu | A63B 21/157 |
| 11,413,495 | B2 * | 8/2022 | Carruthers | A63B 22/0046 |
| 11,458,358 | B1 * | 10/2022 | Stearns | A63B 22/001 |
| 2011/0021325 | A1 * | 1/2011 | Summers | A63B 22/203 482/70 |
| 2012/0258843 | A1 * | 10/2012 | Summers | A63B 21/4033 482/93 |

* cited by examiner

*Primary Examiner* — Megan Anderson
(74) *Attorney, Agent, or Firm* — Nick A Nichols Jr

(57) ABSTRACT

In an exercise apparatus resistance may be provide by the inertia of unsprung mass. The exercise apparatus may include a frame and dependently coupled foot support members movably connected to the frame. The foot support members carry a weight mass which may be adjusted to increase or decrease the unsprung mass providing inertial resistance to linear or arcuate acceleration.

17 Claims, 15 Drawing Sheets

INERTIAL RESISTANCE EXERCISE APPARATUS

CROSS-REFERENCE TO RELATED APPLICATION

This application claims priority to and the benefit of the filing date of U.S. Provisional Application Ser. No. 63/205,087, filed Nov. 17, 2020, which application is herein incorporated by reference in its entirety.

BACKGROUND

The present invention relates to inertial resistance exercise apparatus, more particularly, to an exercise resistance system generally having balanced unsprung masses dependently coupled to reciprocating members of an exercise apparatus.

Free weights exercises and most exercise apparatus provide a resisting force in only one direction per exercise stroke. Typically, a user moves a body part against resistance to the end of the exercise stroke and a return motion to the starting position, thereby exercising only one group of muscles during each exercise stroke.

Some exercise apparatus utilize inertia to provide exercise resistance, for example, to increase or decrease the rotational velocity of a mass. Such exercise apparatus, however, only provide work exercise that contracts the muscle while accelerating the mass and is often difficult to change the resistance of inertial exercises. Some inertial resistance exercise apparatus have difficulty providing a constant resistance and/or constant speed of movement.

SUMMARY

In an exercise apparatus resistance may be provided by the inertia of unsprung mass. The exercise apparatus may include a frame and dependently coupled foot support members movably connected to the frame. The foot support members may carry an unsprung mass which may be increased or decreased to provide inertial resistance to linear or arcuate acceleration.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

In an inertial resistance exercise apparatus, the mass or weight of balanced, dependently coupled, unsprung masses or "free weights" movable in opposition to one another may be changed by adding or removing unsprung mass to user engaged, reciprocating members of the exercise apparatus.

Generally, equal masses (weight) may be added or removed to dependently coupled right and left reciprocating members where the resulting unsprung mass "M" in the equations to follow equals the summation of all mass on both oppositionally reciprocating members, as well as the mass of the connected moving components, although the mass of the connected moving components may be considered insignificant relative to the amount of unsprung mass "M" utilized. The user is considered as "sprung weight" and consequently the mass of the user does not inherently affect the inertial force properties of the exercise apparatus. The weight of the moving foot members is considered as "unsprung weight," a variable which effects the inertial resistance force of the exercise apparatus. Increasing or decreasing the "unsprung weight" decreases or increases the cycle rate of the exercise apparatus when all other variables are the same.

Figure 1B:
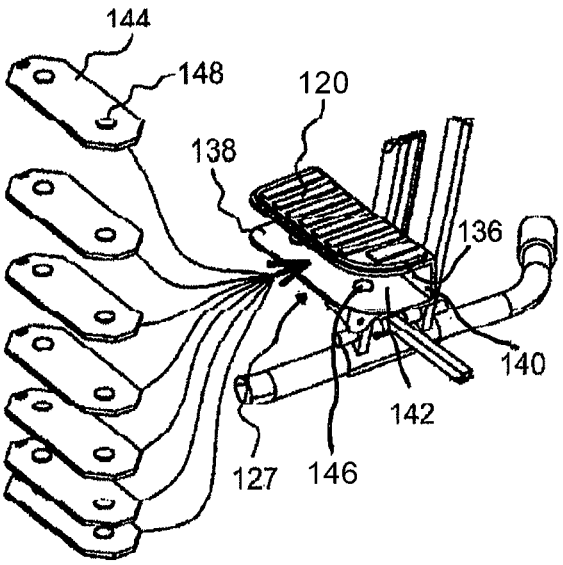
FIG. 1B is a perspective view of a foot support portion of the inertial resistance exercise apparatus shown in FIG. 1.
Figure 1A:
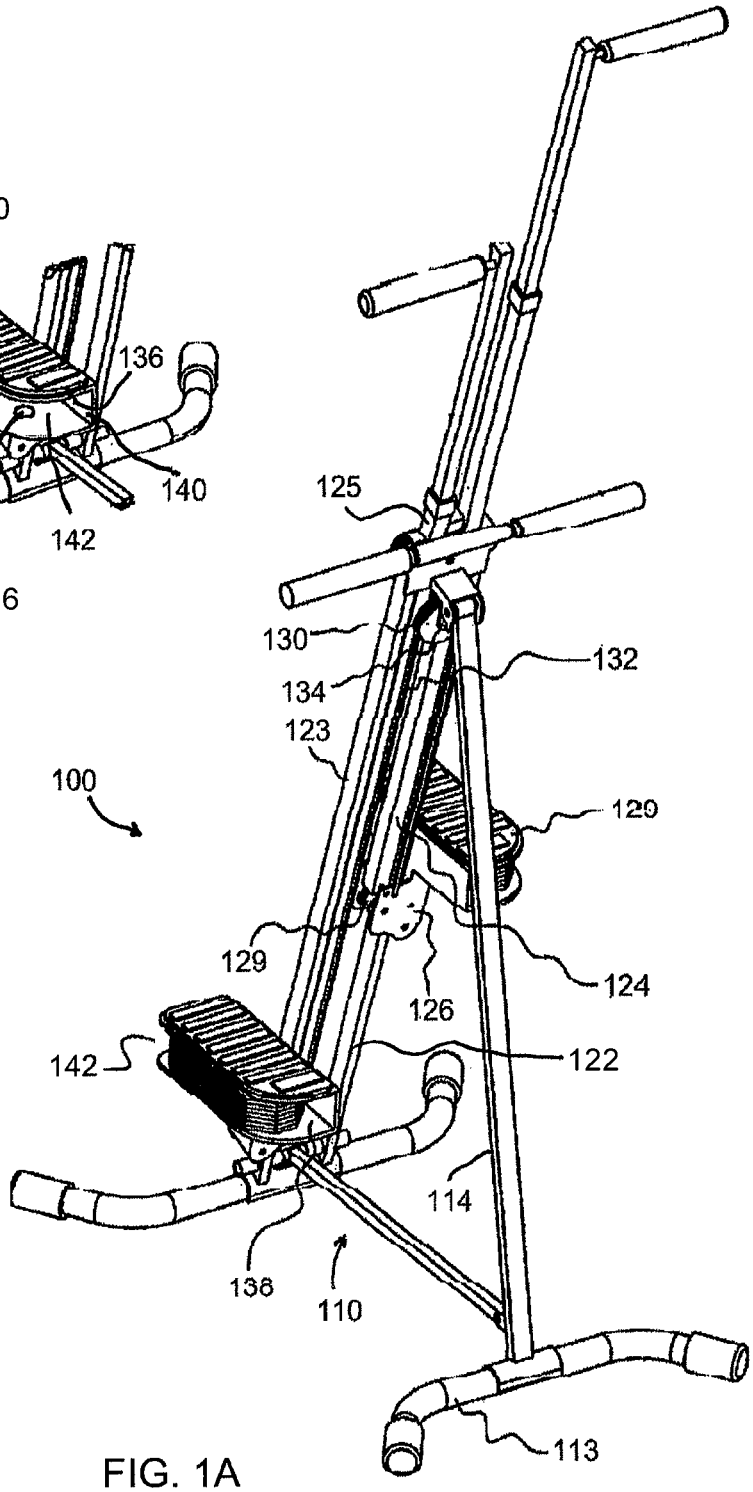
FIG. 1A is a perspective view of a first embodiment of an inertial resistance exercise apparatus.

Referring first to FIG. 1A and FIG. 1B, a first embodiment of an inertial resistance exercise apparatus is generally identified by the reference numeral 100. By way of example but without limitation, the exercise apparatus 100 shown in FIG. 1 is a climber exercise machine. The exercise apparatus 100 may include a frame 110 including a base comprising spaced apart base members 112, 113 interconnected by a cross connect member 114. The exercise apparatus 100 is similar to the climber exercise apparatus disclosed in U.S. Pat. No. 10,179,260, which patent is herein incorporated by reference in its entirety.

The exercise apparatus 100 may include spaced apart substantially parallel track or guide members 122, 123 secured to the frame 110 and generally extending upward from the base 110. The guide members 122, 123 movably support a pair of elongated reciprocating members 124,125, respectively. The reciprocating members 124, 125 may linearly reciprocate relative to the guide members 122, 123. Foot supports 126 may be secured proximate the lower distal ends of the reciprocating members 124, 125, generally in a non-adjustable manner. The right and left generally vertically moving reciprocating members 124, 125 may be linearly constrained along guide members 122, 123 by rollers 129 rotatably secured to right and left foot supports 126. The foot supports 126 may alternatively be constrained along guide members 122, 123 by low friction sliding surfaces in a manner known in the art. Foot platforms or pedals 120 may be fixedly secured to foot supports 126. A pulley 130 may be rotatably secured to the frame 110 at shaft 134. A cable 132 may be looped over the pulley 130. The opposite ends of the cable 132 may be secured to respective reciprocating members 124, 125 at the foot supports 126.

The exercise apparatus 100 may provide for means to omit hydraulic, magnetic, or friction elements, while providing adjustable inertial resistance which is highly desirable during the climbing action, and which is maintenance free. The foot supports 126, shown in greater detail in FIG. 1B, may include a generally horizontal C-shaped foot bracket 127. The bracket 127 may include a top wall 136, a bottom wall 138 and a sidewall 140 defining a cavity 142. One or more weight plates 144 may be received in the cavity 142. The weight plates 144 may be stacked on one another. The bottom wall 138 of the foot brackets 127 may include one or more nesting bosses 146 adapted for engagement with recesses 148 in the weight plates 144 for securing the stack of weight plates 144 in the cavity 142.

By way of illustration but without limitation, the exercise apparatus 100 depicted in FIGS. 1A and 1B, may support up to seven weight plates 144 in the cavity 142 of each foot bracket 127. Each weight plate 144 may weigh about 2.5 pounds for a total of about 17.5 pounds per foot bracket 127. Generally, each foot bracket 127 is loaded with an equal number of weight plates 144 (mass) to ensure balance and minimize vibration of the exercise apparatus 100. In the example shown in FIG. 1A, the reciprocating (balanced weight/mass) per side of the exercise apparatus 100 is 17.5 pounds for a total of 35 pounds.

In order to facilitate operation of the exercise apparatus 100, a computer program accessible from a console may be used to select various parameters and the consequences of such parameters with regard to the type of cardio or strength exercise to be experienced by a user. For example, the user may select a desired step height to be performed with an associated stepping resistance and cycle frequency, and the program prompts the user to add the appropriate inertial mass M to the exercise apparatus 100.

Referring still to FIG. 1A, as an example, but not by way of limitation, the stack of weight plates 144 carried by each bracket 127 weighs 17.5 pounds, and the approximate weight of the vertically reciprocating members 124, 125 is about 4 pounds. The weight of the weights 144 and weight of the reciprocating members 124, 125 equals about 21.5 unsprung pounds on each side of the exercise apparatus 100.

The governing dynamic equations of operation are:

$F=ma$ $S=H/2$, where $S$ is the distance from zero velocity to maximum velocity, or one half the stepping height.

$S=(½)*(\text{at } 2)$ $t=\text{square root}(2*S/a)$, or:

$t^2=(2*S)/a$, or:

$a=(2*S)/(t^2)$

For the sample calculations below, the acceleration value is assumed to be constant both up to, and away from, the midpoint of the stroke range. This assumption assumes constant positive acceleration and an instant negative change (not a smooth curve function) of acceleration at the midpoint of the stroke range. However, for this purpose the assumption is suitable for a sample calculation, where:

H=8 inches
S=4 inches (0.33 ft)
F=10 pounds peak resistance
Z=60 cycles per minute, or t=0.25 seconds
We have:

$S=8/2=4 \text{ inches}=0.33 \text{ ft}$ $a=(2*S)/t$ $a=(2(0.33)/(0.25*0.25))$ $a=10.5 \text{ ft/sec}^2$ $F=M/a$, or $M=F/a$ $M=10/10.5=0.95 \text{ slugs}$ (note: 1 slug=32.17 pounds at the earth surface)
Result: Total M=0.95 slugs, or 15.3 pounds of weight plates on each foot member where F=10 pounds.

For a more accurate analysis, the following examples have been solved with Working Model 4.0.1 Computer Motion Analysis Software, and where typical combinations of reciprocating mass, stroke cycle length (orientation with respect to gravity direction not a significant factor), stroke cycles per minute, and peak force required to drive the resistance system is shown in TABLE 1 below. As the user may observe, the present apparatus may be utilized on cardio as well as strength equipment.

TABLE 1

| Example | Total Reciprocating weight (M) | Stroke Length | Stroke Frequency | Reaction Pound Force Max |
|---|---|---|---|---|
| Example 1 | 35 Pounds | 12 inches | 50 cycles/min | 14 Pounds Force |
| Example 2 | 150 Pounds | 20 inches | 30 cycles/min | 24 Pound Force |
| Example 3 | 250 Pounds | 10 inches | 22 cycles/min | 38 Pound Force |
| Example 4 | 700 Pounds | 20 inches | 20 cycles/min | 80 Pounds Force |
| Example 5 | 250 Pounds | 20 inches | 40 cycles/min | 110 Pounds Force |
| Example 6 | 700 Pounds | 20 inches | 31 cycles/min | 200 Pounds Force |
| Example 7 | 700 Pounds | 20 inches | 60 cycles/min | 740 Pounds Force |

Figure 2:
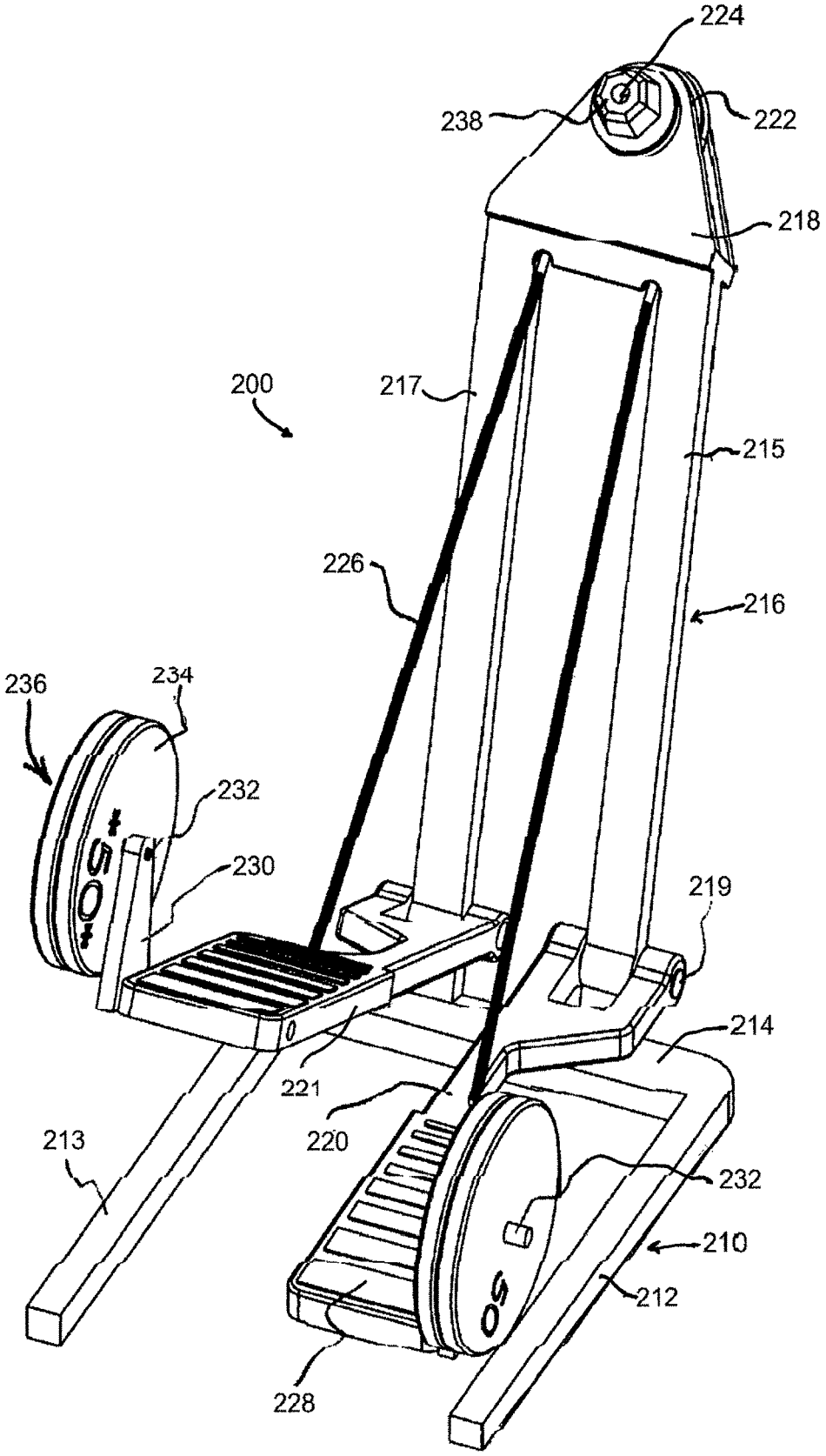
FIG. 2 is a perspective view of a second embodiment of an inertial resistance exercise apparatus.

Referring now to FIG. 2, a second embodiment of an inertial resistance exercise apparatus is generally identified by the reference numeral 200. By way of example but without limitation, the exercise apparatus 200 is a stepper exercise machine. The exercise apparatus 200 may include a frame having a base 210 comprising spaced apart base members 212, 213 interconnected by a cross connect member 214. A stanchion 216 fixedly secured to the cross member 214 may extend generally vertically upward from the base 210. The stanchion 216 may include spaced apart leg members 215 and 217 connected at their upper ends by a bridge member 218.

Foot support members 220 and 221 may be pivotally connected to respective leg members 215, 217 at pivot shafts 219. A pulley 222 may be rotatably secured to the bridge member 218 at shaft 224. A cable 226 may be looped over the pulley 222. The opposite ends of the cable 226 may be secured to respective foot support members 220, 221. The distal ends of the foot support members 220, 221 may define foot platforms 228 sized and configured to support a user's foot. The foot platforms 228 may be integrally formed with or rigidly secured to respective foot support members 220, 221.

Upstanding weight support members 230 may be fixedly secured proximate the distal ends of the foot support members 220, 221. Weight support shafts 232 may project outwardly from the weight support members 230. Weights 234, such as standard bar bell weights, may be mounted on the weight support shafts 232. The assembled weights 234 form weight packs 236 mounted on each side of the exercise apparatus 200. The weight packs 236 and foot support members 220, 221 comprise the unsprung mass M of the inertial resistance system. Resistance may be optionally increased by manipulation of a friction adjustment knob 238 rotatably secured at the shaft 224.

Figure 3B:
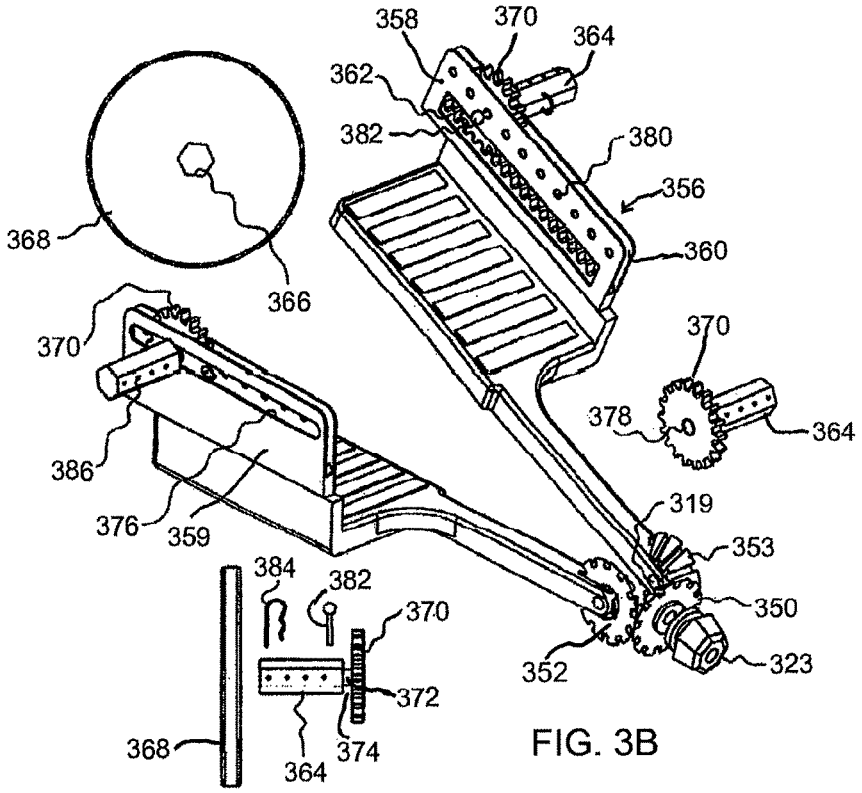
FIG. 3B is an exploded perspective view of the inertial resistance exercise apparatus shown in FIG. 3A without the frame.
Figure 3A:
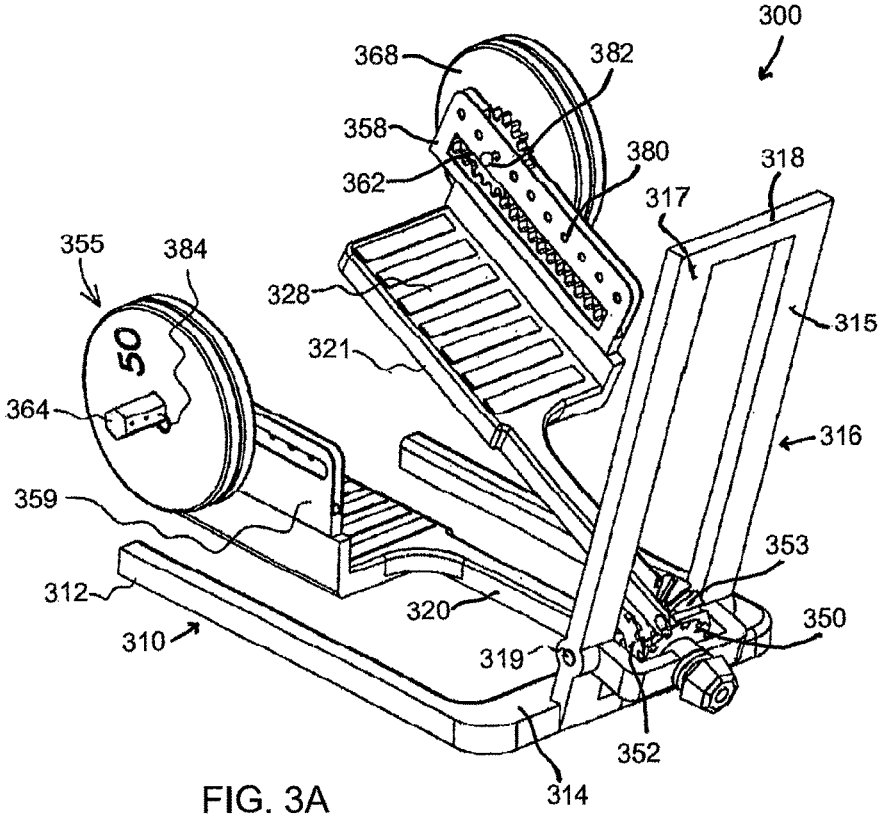
FIG. 3A is a perspective view of a third embodiment of an inertial resistance exercise apparatus.

Referring next to FIG. 3A and FIG. 3B, a third embodiment of an inertial resistance exercise apparatus is generally identified by the reference numeral 300. By way of example but without limitation, the exercise apparatus 300 is a stepper exercise machine similar to the exercise apparatus 200. The exercise apparatus 300 may include a frame having a base 310 comprising spaced apart base members 312, 313 interconnected by a cross connect member 314. A stanchion 316 fixedly secured to the cross member 314 may extend generally vertically upward from the base 310. The stanchion 316 may include spaced apart leg members 315 and 317 connected at their upper ends by a bridge member 318. Foot support members 320 and 321 may be pivotally connected to respective leg members 315, 317 at pivot shafts 319. The distal ends of the foot support members 320, 321 may define foot platforms 328 sized and configured to support a user's foot. The foot platforms 328 may be integrally formed with or rigidly secured to respective foot support members 320, 321.

The foot support members 320, 321 may be coupled to the frame 310 in a bevel gear arrangement where a central bevel gear 350 is rotatably secured to the frame 310. Bevel gears 352 and 353 may be fixedly secured to the forward or proximal ends of foot support members 320, 321, respectively. The bevel gears 352, 353 may engage the central bevel gear 350 such that rotation of a foot support member 320, 321 about its pivot shaft 319, causes the central bevel gear 350 to rotate about its pivot shaft 323, which consequently causes the other foot support member 320, 321 to counter rotate about its pivot axis 319, thereby causing the foot support members 320, 321 and associated weight packs 355 to move in a dependent manner. The oppositionally connected divided mass M reciprocates in a manner to provide the desired inertial force resistance.

In this instance, for example, with 100 pounds at each foot support member 320, 321 (mass at each foot member=100 pounds, and M=200 pounds), and with a stepping height of 12 inches at 60 cycles per minute, the user can expect approximately 120 pounds force maximum inertial resistance. It may be noted that during subjective physical testing a smooth transition of perceived forces occurs at the top and bottom of the strokes because both feet are interacting with the foot supports, and any attempts to rapidly change stepping frequency is met with an increase in instant inertial resistance which is proportional to the increased rate of change to which the foot supports may be subjected to.

Upstanding weight support members 356 may be fixedly secured to the foot platforms 328. The weight support members 356 may include elongated plates 358 and 359 spaced apart from one another defining a channel 360 therebetween. A gear rack 362 may form the base of the channel 360.

The weight packs 355 may be mounted on weight support beams 364 which may be movably supported by the weight support members 356. The weight support beams 364 may define a hex profile in cross section for mating engagement with a hex opening 366 in the weights 368 forming the weight packs 355. A pinion gear 370 may be fixedly secured to a shaft 372 interposed between an end of each of the weight support beams 364 and the pinion gears 370. The shafts 372 may be concentric with the longitudinal axis of the support beams 364 and fixedly secured to an end face of the support beams 364 so that the pinion gears 370 are spaced from the end face of the support beams 364 defining an annular groove 374 therebetween.

Each pinion gear 370 may be received in respective channels 360 between the plates 358, 359. The pinion gear shaft 372 may extend through a slot 376 formed in the plates 359 cooperatively engaging with the annular groove 374. The weight support beams 364 may project outwardly from the plates 359. The pinion gear shaft 372 may include an inwardly extending borehole 378. Upon alignment of the borehole 378 with one of a plurality of pin holes 380 in the plate 358, a retaining pin 382 may be inserted through one of the plurality of holes 380 into the borehole 378 of the pinion gear shaft 372 to lock the beams 364 to the weight support members 356.

The distance of the weight support beam 364 from the pivot shaft 319 of the foot support members 320, 321 may be increased or decreased. The inertial force resistance may be increased when weight support beams 364 and consequently the weight packs 355 are positioned further from the pivot shafts 319, or inertial force resistance may be decreased when weight support beams 364 are positioned closer to the pivot shafts 319. The user may adjust inertial resistance, by pulling retainer pin 382 out of a pin hole 380, and rotating weight packs 355 toward a preferred position. The pinion gear 370 engages gear rack 362 as it rotates so that the weight support beam 364 moves along foot member slot 376. Thereafter the retainer pin 382 may be reinserted into a pin hole 380 to lock the weight packs 355 relative to foot member 320. Spring clips 384 may be inserted into a clip hole 386 of the weight support beams 364 to secure the weight packs 355 to weight support beams 364.

Figure 4:
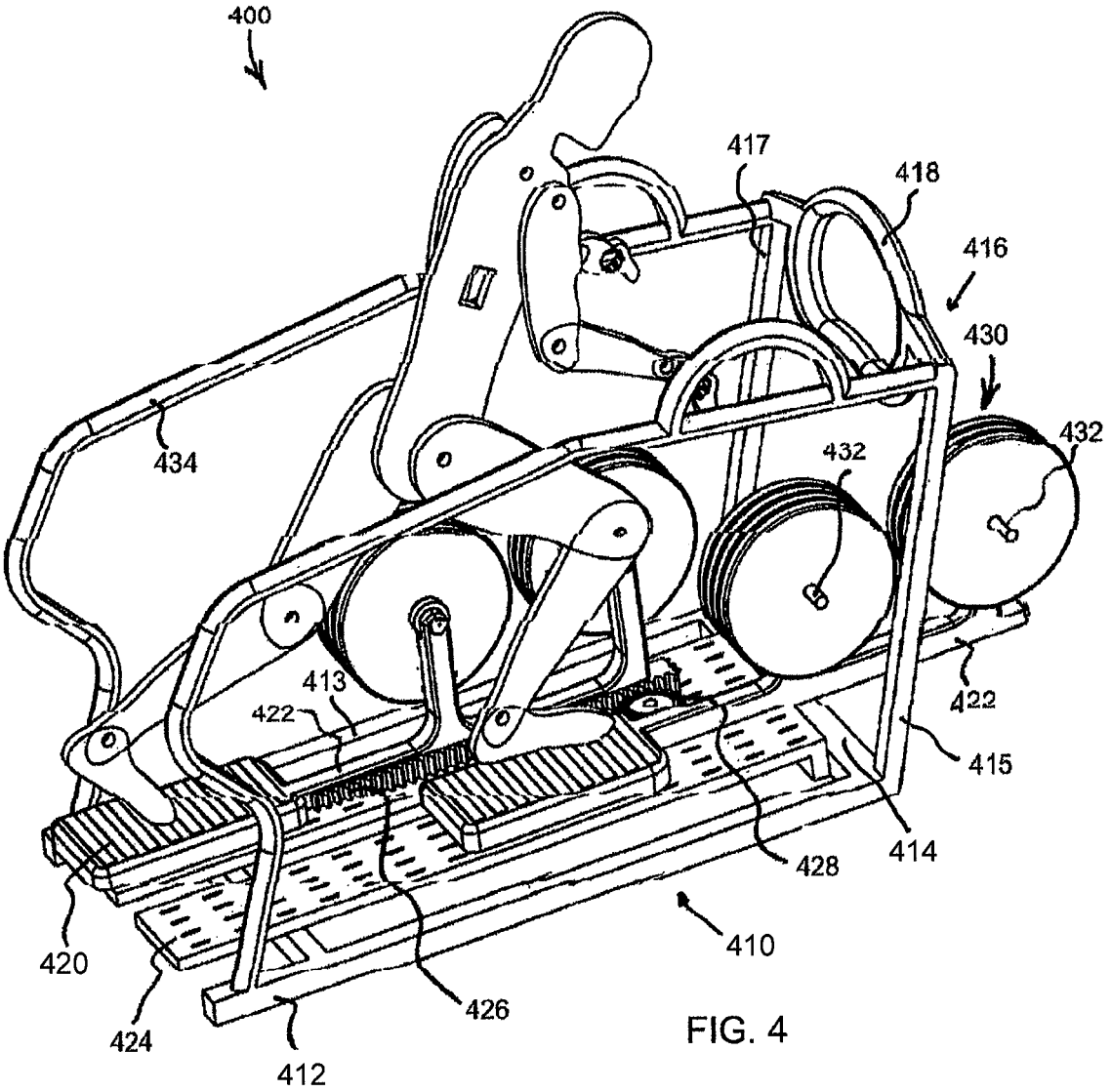
FIG. 4 is a perspective view of a fourth embodiment of an inertial resistance exercise apparatus.

Directing attention now to FIG. 4, a fourth embodiment of an inertial resistance exercise apparatus is generally identified by the reference numeral 400. The exercise apparatus 400 may include a frame having a base 410 comprising spaced apart base members 412, 413 interconnected by a cross connect member 414. A stanchion 416 fixedly secured to the cross member 414 may extend generally vertically upward from the base 410. The stanchion 416 may include spaced apart leg members 415 and 417 connected at their upper ends by a bridge member 418.

The exercise apparatus 400 may simulate pushing a sled across a floor with significant resistance during an exercise known as "sled training." Foot platforms 420 may reciprocate linearly front to rear as the user leans forward and pushes backward against the foot platforms 420 with the user's feet, or alternatively the user may wear a body harness and be tethered to the front stanchion 416 of the of the apparatus 400 such that the user may lean backward and exert forward pushing force against the foot platforms 420.

In this "sled" category of the exercise apparatus 400, the user's weight is not directly applied advantageously in the direction of motion against the foot platforms 420 because the foot platforms 420 do not have a vertical component of motion. For example, note that in the stepper apparatus 200 shown in FIG. 2, the user may balance between the right and left foot platforms 220, 221. However, instead of balancing between right and left foot platforms 220, 221 to some degree, the user may alternatively apply and remove full body weight in an alternating manner against one or the other of the vertically moving foot platforms 220, 221. In this respect, considerations as to the appropriate unsprung mass M must be made in the context of the particular category of exercise machine being considered.

Referring still to FIG. 4, each foot platform 420 may be fixedly secured to respective foot members 422, where right and left foot members 422 are linearly constrained to move along respective right and left foot member races 424. The interface between the foot members 422 and the foot member races 424 may be rollers or for example but without limitation, simply a low friction surface material without employing rollers. In the embodiment of the exercise apparatus 400, because sled training may involve pushing the foot platforms 420 either forward or rearward, a rack 426 and pinion gear 428 arrangement is shown, where a rack 426 (also known as a "rack gear") may be rigidly secured to each foot member 422, and a center pinion gear 428 may be rotatably secured to the machine frame 410. The unsprung mass of the weight packs 430 may be supported by weight support beams 432 at each foot member 422 in a divided manner, and the total mass of all weight packs 430 is equal to the desired total unsprung mass M. Handrails 434 may be provided so the user may be able to increase tractive forces delivered to the foot platforms 420.

Figure 5:
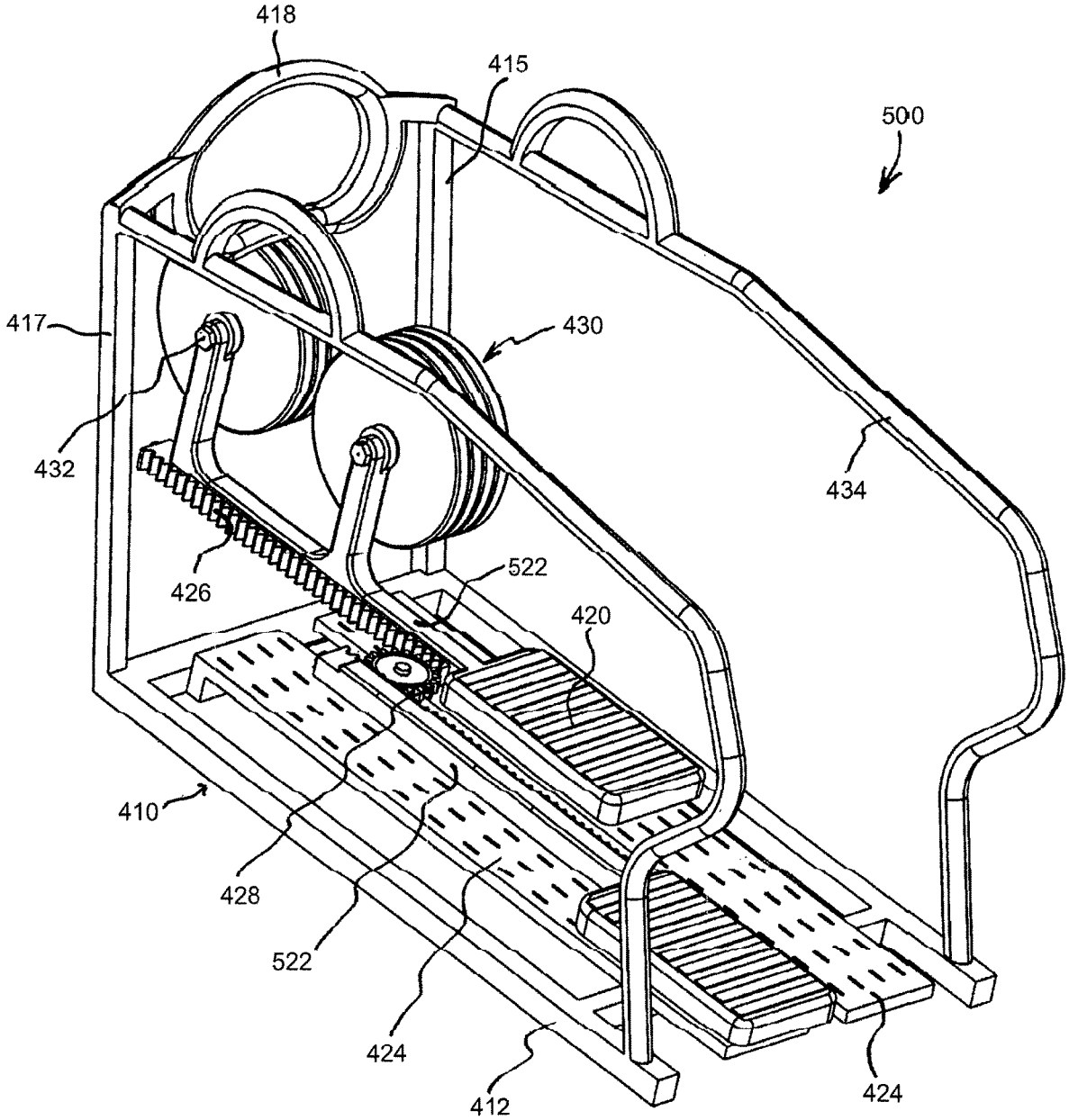
FIG. 5 is a perspective view of a fifth embodiment of an inertial resistance exercise apparatus.

Referring now to FIG. 5, a fifth embodiment of an inertial resistance exercise apparatus is generally identified by the reference numeral 500. As noted by the use of common reference numerals, the exercise apparatus 500 is similar to the exercise apparatus 400 with the exception that the unsprung mass M of the exercise apparatus 500 is secured to only one foot member 522. In this configuration, foot members 522 do not move vertically, and are constrained to only move along a horizontal plane. In the embodiments where the foot members move vertically, supporting the unsprung mass M by only one foot member simply results in the exercise apparatus functioning like a weight-lifting exercise machine which is inherently a completely different type of exercise machine, as compared to the present invention where the unsprung mass M is divided between left and right moving members of the exercise apparatus in a statically 'weight balanced' manner. Although the configuration of the exercise apparatus 500 may provide inertial force resistance to the user, it may also be noted that the exercise apparatus 500 is inherently dynamically unbalanced and subject to vibration.

Figure 6:
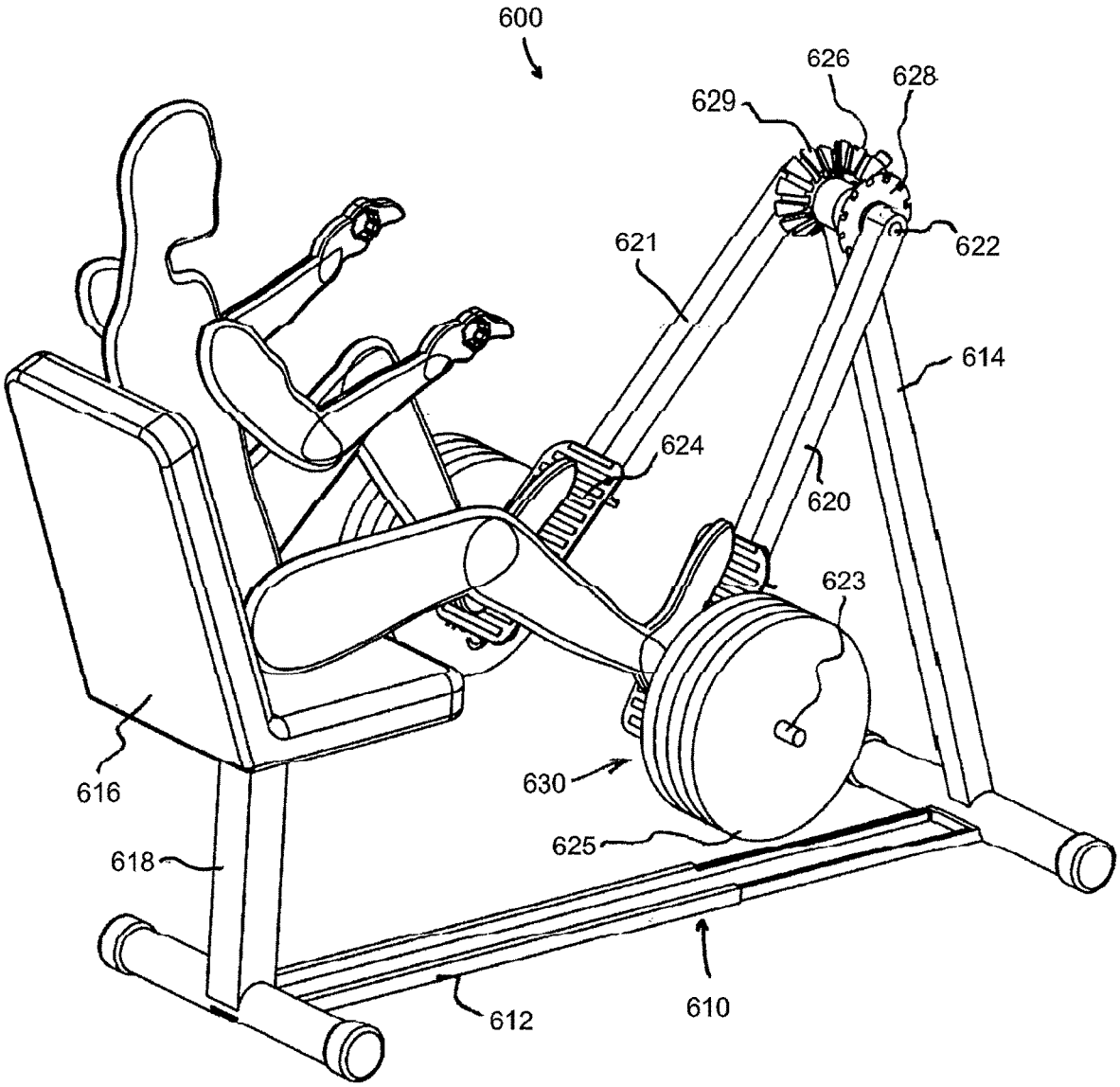
FIG. 6 is a perspective view of a sixth embodiment of an inertial resistance exercise apparatus.

Directing attention now to FIG. 6, a sixth embodiment of an inertial resistance exercise apparatus is generally identified by the reference numeral 600. The exercise apparatus 600 is a recumbent style exercise apparatus. The exercise apparatus 600 may include a frame 610 comprising a base 612 and a stanchion 614 fixedly secured at a forward end of the base 612. The stanchion 614 may extend generally vertically upward at a slight angle toward a user seated on a seat 616 supported by an upstanding post 618 fixedly secured at a rear end of the base 612.

Foot support members 620 and 621 may be pivotally connected proximate an upper distal end of the stanchion 614 at pivot shaft 622. At the distal ends of the foot support members 620, 621, foot platforms 624 may be sized and configured to support a user's foot. The foot platforms 624 may be integrally formed with or rigidly secured to respective foot support members 620, 621. Weight support shafts 623 may be fixedly secured proximate the distal ends of the foot support members 620, 621. The weight support shafts 623 may project outwardly from the weight support members 620, 62L Weights 625, such as standard bar bell weights, may be mounted on the weight support shafts 623. The assembled weights 625 form weight packs 630 mounted on each side of the exercise apparatus 600. The weight packs 630 and foot support members 620, 621 comprise the unsprung mass M of the inertial resistance system.

The foot support members 620, 621 may be coupled to the stanchion 614 in a bevel gear arrangement where a central bevel gear 626 may be rotatably secured to the upper distal end of the stanchion 614. Bevel gears 628 and 629 may be fixedly secured to the forward or proximal ends of foot support members 620, 621, respectively. The bevel gears 628, 629 may engage the central bevel gear 626 such that rotation of a foot support member 620, 621 about pivot shaft 622, causes the central bevel gear 626 to rotate about its pivot axis, which consequently causes the other foot support member 620, 621 to counter rotate about pivot shaft 622, thereby causing the foot support members 620, 621 and associated weight packs 630 to move in a dependent manner. The oppositionally connected divided mass M reciprocates in a manner to provide the desired inertial force resistance. For example, for purposes of illustration but without limitation, assuming the weight packs 630 each weigh 200 pounds and a stepping height of 12 inches at 60 cycles per minute, the user may expect 240 pounds-force maximum inertial resistance. Slowing the cycle rate down to 30 cycles per minute, the user may expect 60 pounds-force maximum inertial resistance at the same stroke length and unsprung mass M. As with any of the other embodiments shown and described herein, magnetic, frictional, or hydraulic resistance components may be included with the exercise apparatus 600, as desired.

Figure 7A:
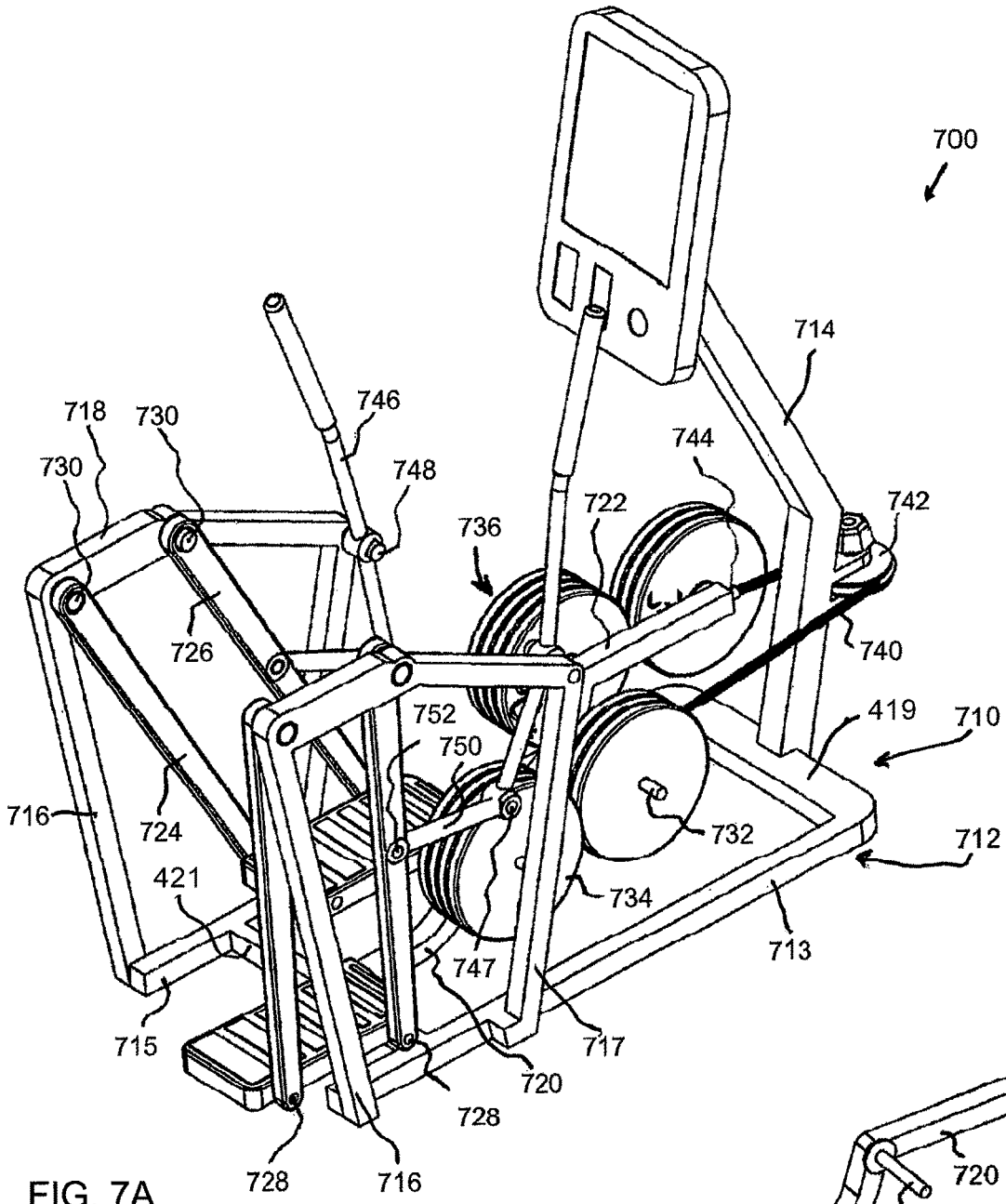
FIG. 7A is a perspective view of a seventh embodiment of an inertial resistance exercise apparatus.
Figure 7B:
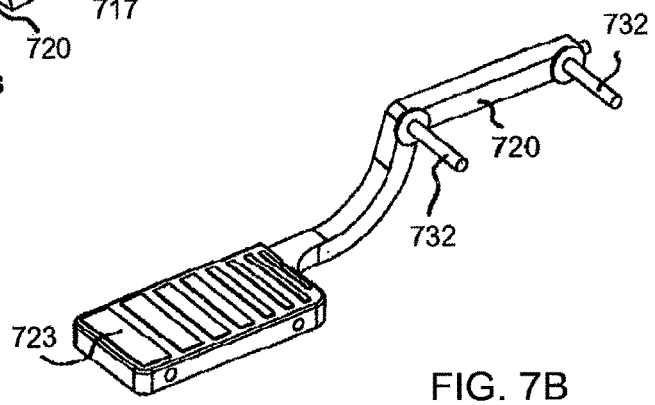
FIG. 7 B is a perspective view of the foot support element of the inertial exercise apparatus shown in FIG. 7A.

Referring now to FIG. 7A and FIG. 7B, a seventh embodiment of an exercise apparatus is generally identified by the reference numeral 700. The exercise apparatus 700 may include a frame 710 including a base 712 and a stanchion 714 fixedly secured to a forward end of the base 712. The stanchion 714 may extend generally vertically upward from the base 712. The base 712 may include spaced apart base members 713 and 715 interconnected by a cross connect member 719 at the forward end of the base 712 and a cross connect member 721 proximate the distal ends of the base members 713, 715. A pair of generally vertically extending frame members 716, 717 may be fixedly secured on each side of the base 712 proximate a distal end thereof. The pair of frame members 716, 717 may be spaced apart from one another fixedly secured to respective base members 713, 715, and connected at their upper ends by a bridge member 718.

The pair of frame members 716, 717 may define a gap therebetween sufficiently sized to accommodate foot support members 720 and 722 pivotally connected at the lower ends of respective dual rocker arms 724, 726 at pivot joints 728. The upper ends of the dual rocker arms 724, 726 may be pivotally connected to bridge members 718 at joints 730. The foot support members 720, 722 may be generally maintained horizontal and in parallel relationship by the rocker arms 724, 726.

In FIG. 7B, the right side foot support member 720 is shown. Foot support member 722 is identical to foot support member 720. The distal ends of the foot support members 720, 722 may define foot platforms 723 sized and configured to support a user's foot. The foot platforms 723 may be integrally formed with or rigidly secured to respective foot support members 720, 722. Two or more weight support beams 732 may project outwardly from a proximal or forward portion of the foot support members 720, 722. The weights 734 assembled on the weight support beams 732 define weight packs 736. The weight support beams 732 may be spaced apart to accommodate linear alignment of the weight packs 736.

The foot support members 720, 722 may be dependently coupled by a cable and pulley system, where a cable 740 may be looped over a pulley 742 fixedly secured to the stanchion 714. The opposite distal ends of the cable 740 may be secured to respective foot support members 720, 722 at cable fastener 744, so that the foot support members 720, 722 and unsprung mass M move in oppositional reciprocating movement. It may be observed that it is inconsequential if the weight packs 736 (unsprung mass M) rise or descend during a user's exercise performance because the right and left weight packs 736 are statically balanced against each other. The exercise apparatus 700 provides a means to extract purely inertial resistance, and the direction of gravity generally does not affect the magnitude of the inertial force resistance felt by the user.

Referring again to FIG. 7A, right and left arm members 746 may be rotatably connected to the frame 710 at joint 748. Connector bars 750 may be rotatably connected to a lower distal end of respective right and left arm members 746 at pivot joints 747. The opposite distal ends of the connector bars 750 may be rotatably connected to an intermediate region of respective dual rocker arms 724, 726 at pivot joints 752. This connection arrangement may permit cross crawl or oppositional (contralateral) movement of same side arms and legs of the user.

Figure 8:
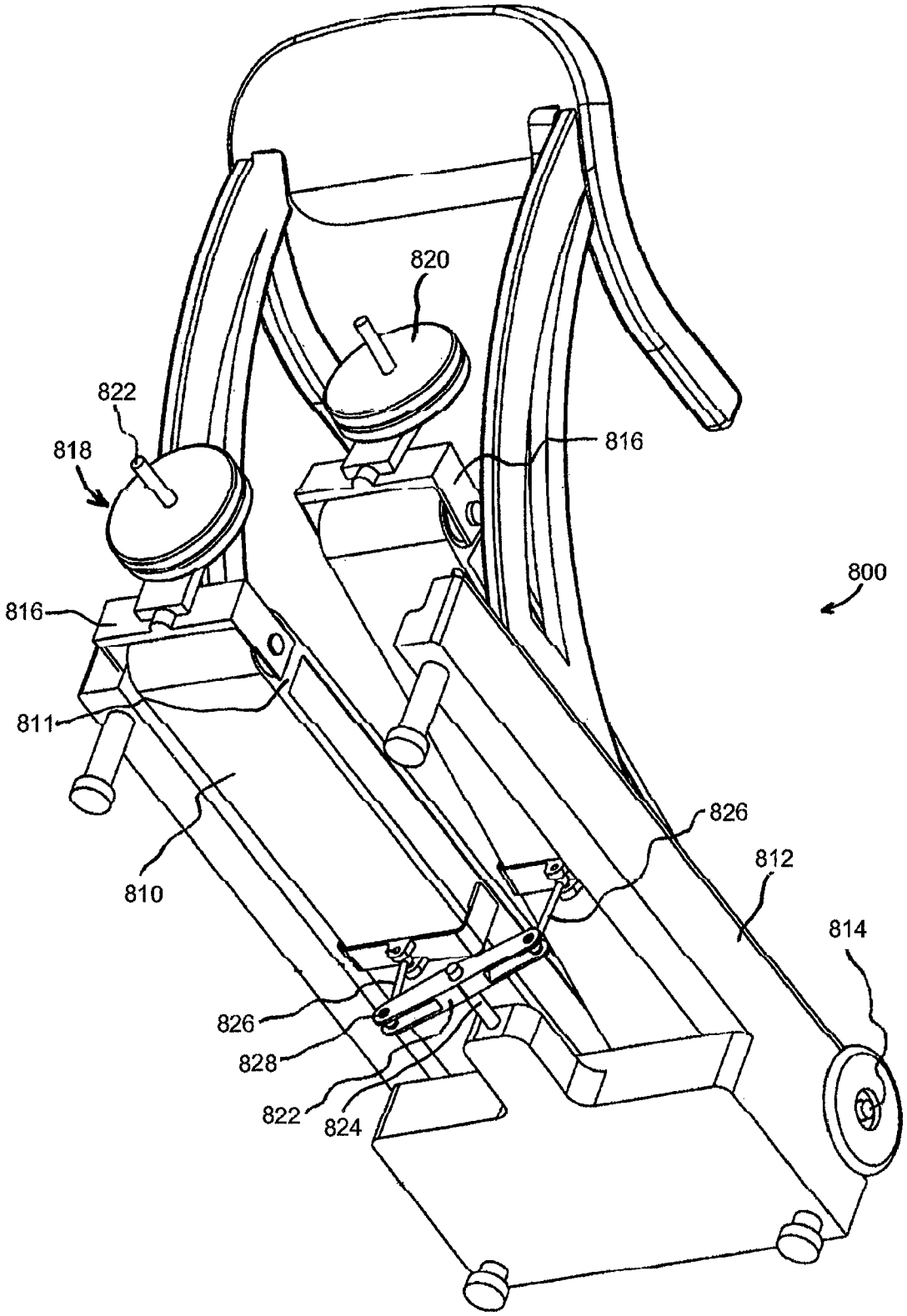
FIG. 8 is a perspective view of an eighth embodiment of an inertial resistance exercise apparatus.

Referring now to FIG. 8, an eighth embodiment of an inertial resistance exercise apparatus is generally identified by the reference numeral 800. The exercise apparatus 800 may comprise a dual belt treadmill exercise apparatus where treadmill belts 810 may provide moving surfaces configured to provide a user with a walking or jogging type exercise. The treadmill belts 810 may be movably secured to right and left belt platforms 811 pivotally secured to a treadmill frame 812 at pivot joint 814.

End brackets 816 may be fixedly secured to a forward end of each of the belt platforms 811. Weight packs 818, comprising one or more weights 820, may be supported on forwardly extending weight beams 822 fixedly secured to the end brackets 816. A predetermined number of weights 820 may be assembled such that the unsprung weight of the weight packs 818 is sufficient for the intended mode of operation, i.e., walking or jogging/running, of the exercise apparatus 800.

The forward region of the treadmill belts 810 move up or down as a user walks or runs on the treadmill belts 810. The user is effectively actuating the forward regions of the belts 810 vertically while the belt platforms 811 are dependently coupled to a rocker 822. The rocker 822 may be pivotally secured to a pivot shaft 824 fixedly secured to the frame 812. Connector rods 826, pivotally secured to respective right and left belt platforms 811, pivotally connect to the opposite distal ends of the rocker 822 at pivot joints 828 in a manner dependently coupling the right and left belt platforms 811.

Figure 9:
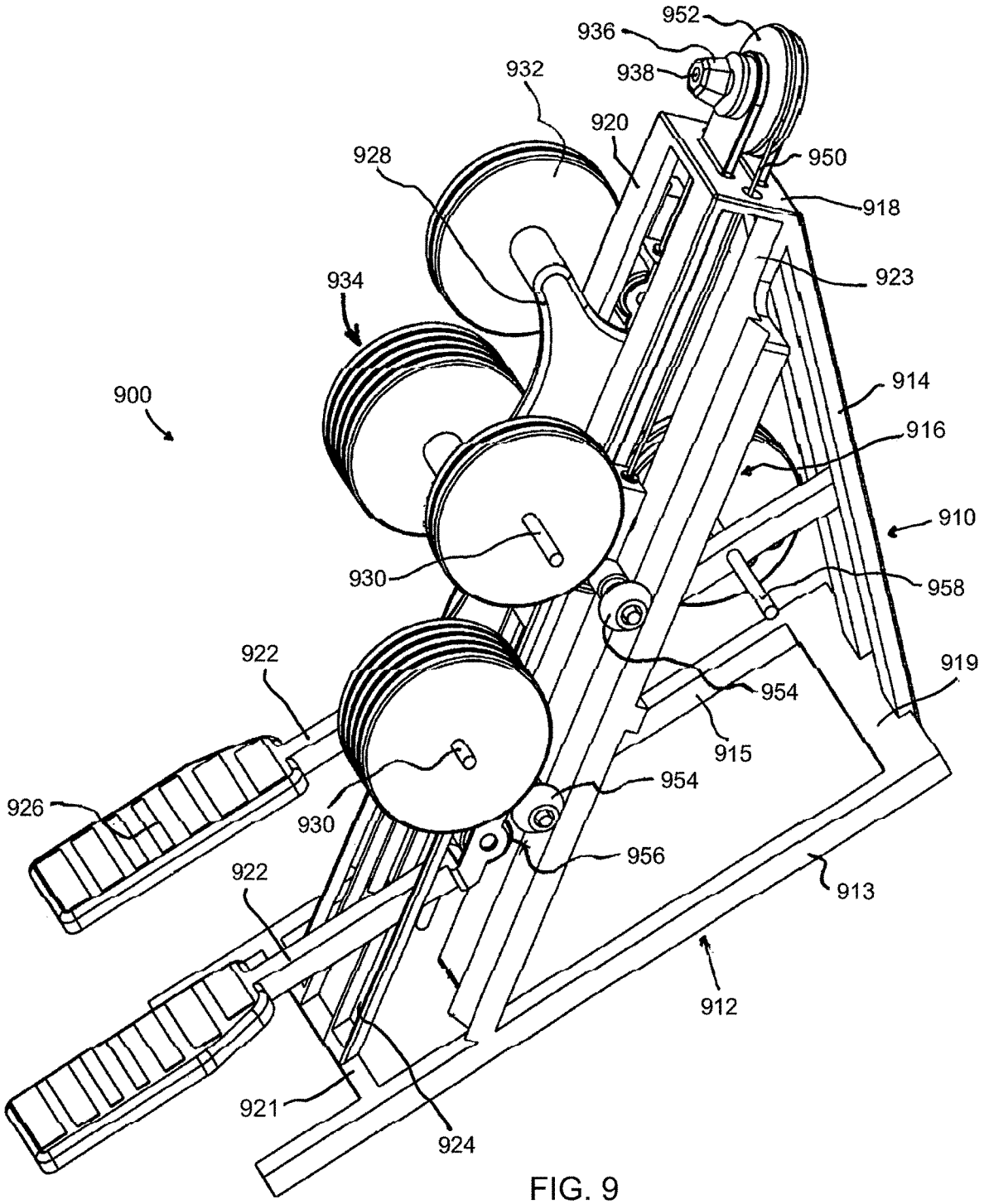
FIG. 9 is a perspective view of a ninth embodiment of an inertial resistance exercise apparatus.

Referring now to FIG. 9, a ninth embodiment of an inertial resistance exercise apparatus is generally identified by the reference numeral 900. The exercise apparatus 900 may include a frame 910 including a base 912 and a stanchion 914 fixedly secured to a forward end of the base 912. The stanchion 914 may extend generally vertically upward from the base 912. The base 912 may include spaced apart base members 913 and 915 interconnected by a cross connect member 919 at the forward end of the base 912 and a cross connect member 921 proximate the distal ends of the base members 913, 915. The frame 910 may further include a pair of inclined generally vertically extending guide assemblies 916 that are spaced apart from one another fixedly secured to the base 912 and connected at their upper ends to the stanchion 914 by a bridge member 918. The guide assemblies 916 may include leg members 920 and 923 that are spaced apart from one another front to rear. The lower portion of the leg members 920, 923 may be bifurcated defining a longitudinal gap 924.

Referring still to FIG. 9, foot support members 922 may be constrained to travel linear reciprocating foot paths along the gap 924 defined by the leg members 920, 923. The distal ends of the foot support members 922 define foot platforms 926 sized and configured to support a user's foot. The foot platforms 926 may be integrally formed with or rigidly secured to respective foot support members 922. One or more upstanding weight support members 928, spaced apart from each other, may extend vertically upward from the foot support members 922. Weight support shafts 930 may project outwardly from the weight support members 928. Weights 932 may be mounted on the weight support shafts 930. The assembled weights 932 form weight packs 934 mounted on each side of the exercise apparatus 900. The weight packs 934 and foot support members 928 comprise the unsprung mass M of the inertial resistance system. Resistance may be optionally increased or decrease by manipulation of a friction adjustment knob 936 rotatably secured at a pivot shaft 938 fixedly secured to the bridge member 918.

The foot support members 922 may be dependently coupled by a cable and pulley system, where a cable 950 may be looped over a pulley 952 fixedly secured to the bridge member 918 of the guide assemblies 916. The opposite distal ends of the cable 950 may be secured to respective foot support members 922, so that the foot support members 922 and unsprung mass M move in oppositional reciprocating movement.

Rollers 954 may be rotatably secured to the foot support members 922. The rollers 954 are configured to travel along frame races 956 forming a portion of the guide assemblies 916. The frame races 956 are generally V-shaped to provide lateral constraints for the reciprocating foot support members 922.

The exercise apparatus 900 may support a total mass M in excess of 1000 pounds, yet the foot platforms 926 are not biased in any direction due to the weight packs 934 being statically balanced between the right and left side of the exercise apparatus 900. While the exercise apparatus 900 may be slow and difficult to operate, such high inertia may be desirable when performing strength training. Spare weights may be stored on frame weight hanger beam 958.

Figure 10:
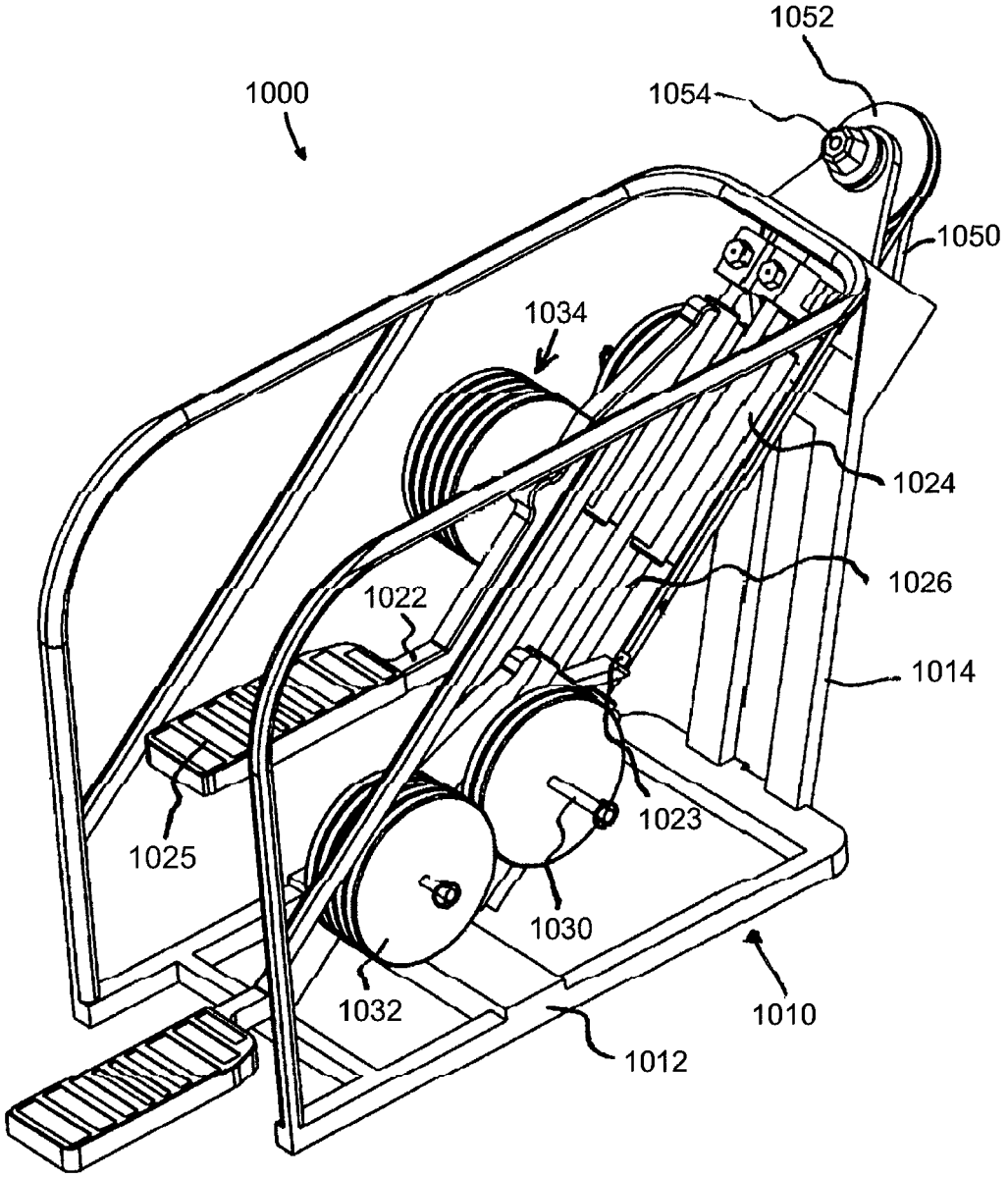
FIG. 10 is a perspective view of a tenth embodiment of an inertial resistance exercise apparatus.
Figure 11:
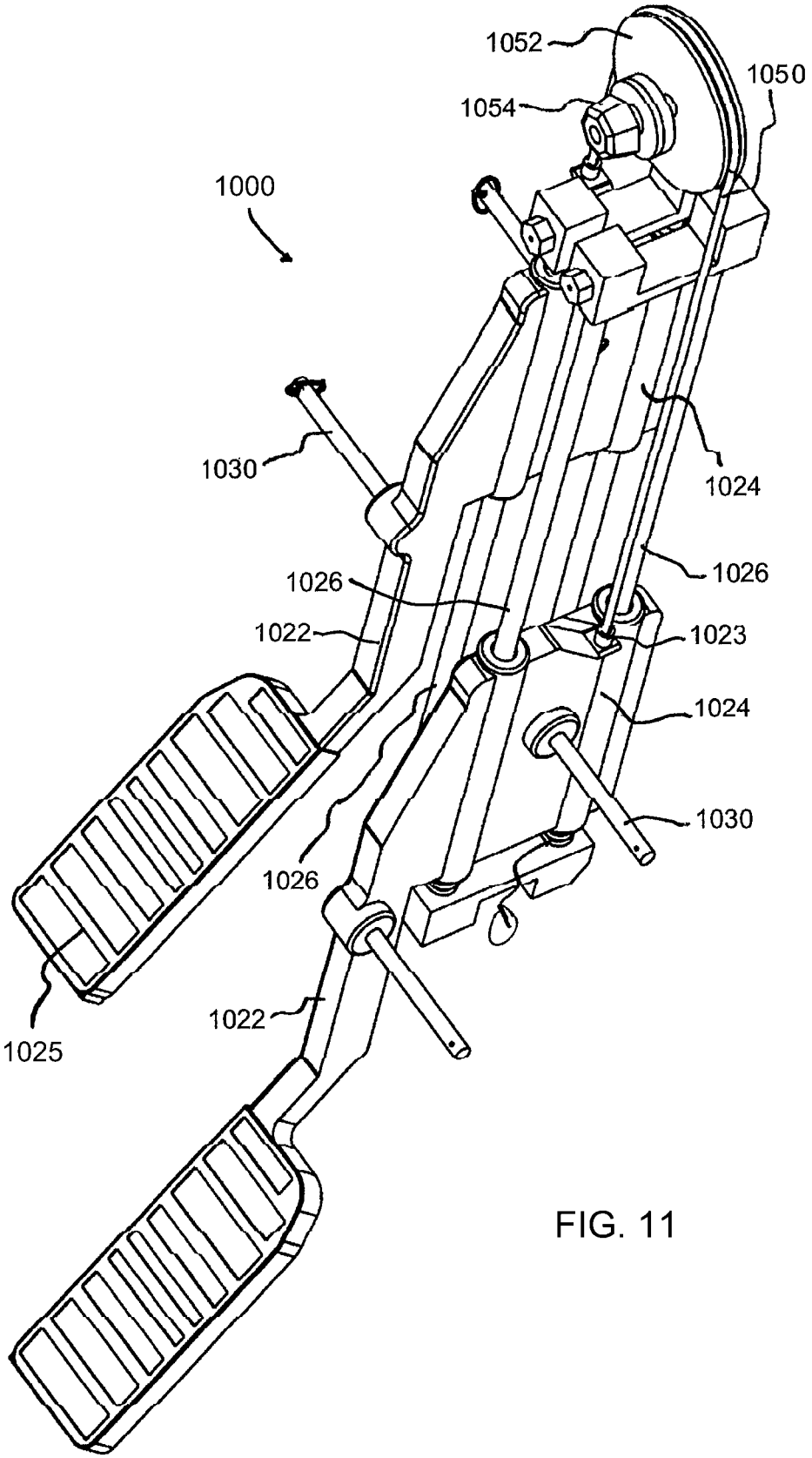
FIG. 11 is a perspective view of the inertial resistance exercise apparatus shown in FIG. 10 without the frame.

Referring now to FIGS. 10 and 11, a tenth embodiment of an exercise apparatus is generally identified by the reference numeral 1000. The exercise apparatus 1000 may be a linear stepping exercise machine similar to the exercise apparatus 900, in that foot support members 1022 reciprocate along an inclined path. The exercise apparatus 1000 may include a frame 1010 including a base 1012 and a stanchion 1014 fixedly secured to a forward end of the base 1012. The foot support members 1022 may be provided with one or more weight support beams 1030 extending outwardly therefrom. The distal ends of the foot support members 1022 define foot platforms 1025 sized and configured to support a user's foot. The foot platforms 1025 may be integrally formed with or rigidly secured to respective foot support members 1022.

Foot support members 1022 may be provided with linear bearings 1024, best shown in FIG. 11, rigidly secured therewith. Typically, such linear bearings 1024 may consist of simple blocks of Ultra High Molecular Weight Polyethylene (UHMW) with through hole(s) bored through in a longitude direction. In other instances, linear ball bearings may be employed. The linear bearings cooperate with linear guide members 1026 which may be rigidly secured to the frame 1010 to constrain the reciprocating foot support members 1022 to move along a relatively long inclined linear foot path.

The foot support members 1022 may be dependently coupled by a cable and pulley system, where a cable 1050 may be looped over a pulley 1052 fixedly secured to the frame 1010. The opposite distal ends of the cable 1050 may be secured to respective foot support members 1022 at cable fasteners 1023. The foot support members 1022 and unsprung mass M move in oppositional reciprocating movement. Frictional resistance may optionally be provided and adjusted with friction adjustment knob 1054. The assembled weights 1032 form weight packs 1034 mounted on each side of the exercise apparatus 1000. The weight packs 1034 and foot support members 1022 comprise the unsprung mass M of the inertial resistance system.

Figure 12:
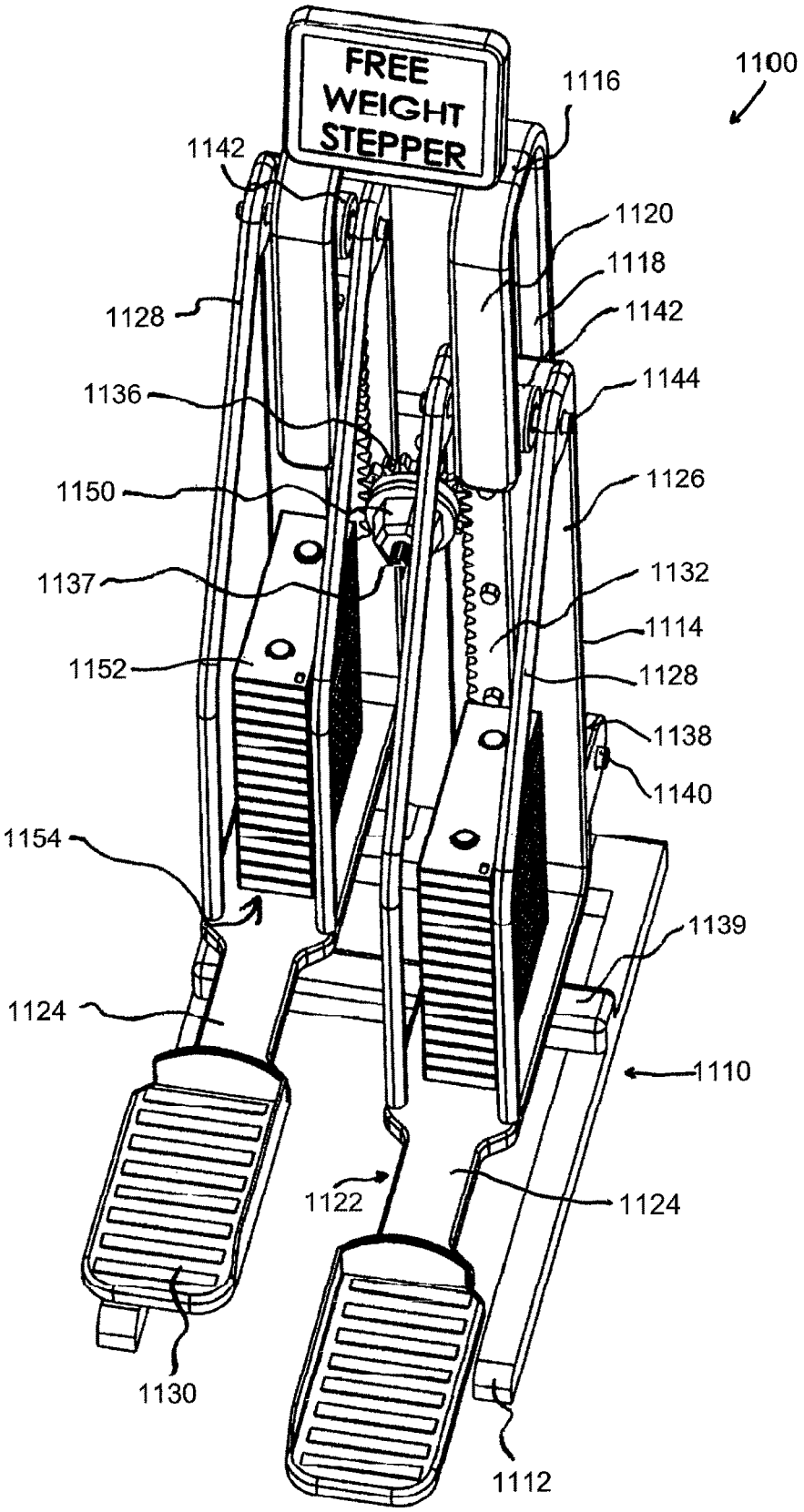
FIG. 12 is a perspective view of an eleventh embodiment of an inertial resistance exercise apparatus.

Referring now to FIG. 12, an eleventh embodiment of an inertial resistance exercise apparatus is generally identified by the reference numeral 1100. The exercise apparatus 1100 may be identified as a free weight stepper exercise apparatus. The exercise apparatus 1100 may include a frame 1110 including a base 1112 and a pair of stanchions 1114 extending generally vertically upward from a forward end of the base 1112. The stanchions 1114 are spaced apart from one another connected at the upper distal ends thereof by a bridge member 1116. The upper ends of the stanchions 1114 may generally define an inverted U-shape having a downwardly extending rear leg member 1118 that is aligned with and spaced from a downwardly extending front leg member 1120.

Foot support members 1122 may include a generally horizontally extending leg member 1124, a generally vertically extending leg member 1126, and a generally angularly extending leg member 1128 connected proximate the upper distal end of the vertically extending leg member 1126 and an intermediate portion of the horizontally extending leg member 1124. The distal ends of the foot support members 1122 may define foot platforms 1130 sized and configured to support a user's foot. The foot platforms 1130 may be integrally formed with or rigidly secured to respective foot support members 1122.

The foot support members 1122 may be dependently coupled by a rack 1132 and a center pinion gear 1136. A rack 1132 may be rigidly secured to each leg member 1126 of foot support members 1124, and the center pinion gear 1136 may be rotatably secured to the frame 1110 at shaft 1137. Lower rollers 1138 (better shown in FIG. 13) and upper rollers 1142 may be rotatably secured to leg members 1126 of the foot support members 1122 at shafts 1140 and 1144, respectively. The lower rollers 1138 may be in rolling contact with a lower race 1146 defined by the rear leg members 1118 of the stanchions 1114. The upper rollers 1142 may be in rolling contact with an upper race 1148 defined by the front leg member 1120 of the stanchions 1114, best shown in FIG. 13. The shaft 1137 may include a threaded distal end to accept an optional knob 1150, whereby tightening the knob 1150 may produce more rotational friction resistance of the pinion gear 1136 during operation of the exercise apparatus 1100. A bumper 1139 may be secured to the base 112 against which one or the other of the foot support members 1124 may contact during dependent motion when the foot support members 1122 are fully lowered. The foot members 1122 are constrained to move vertically by the lower and upper rollers 1138, 1142 in rolling contact with the stanchion 1114.

In the configuration shown in FIG. 12, the assembled weight plates 1152 form weight packs 1154 supported by the leg members 1124 of the foot support members 1122. As an example, but not by way of limitation, each weight plate 1152 may weigh fifteen pounds. Each of the foot support members 1122 may support sixteen weight plates 1152 or 240 pounds for a total of 480 pounds. The weight packs 1034 and foot support members 1024 comprise the dependently coupled unsprung mass M of the inertial resistance system.

Figure 13:
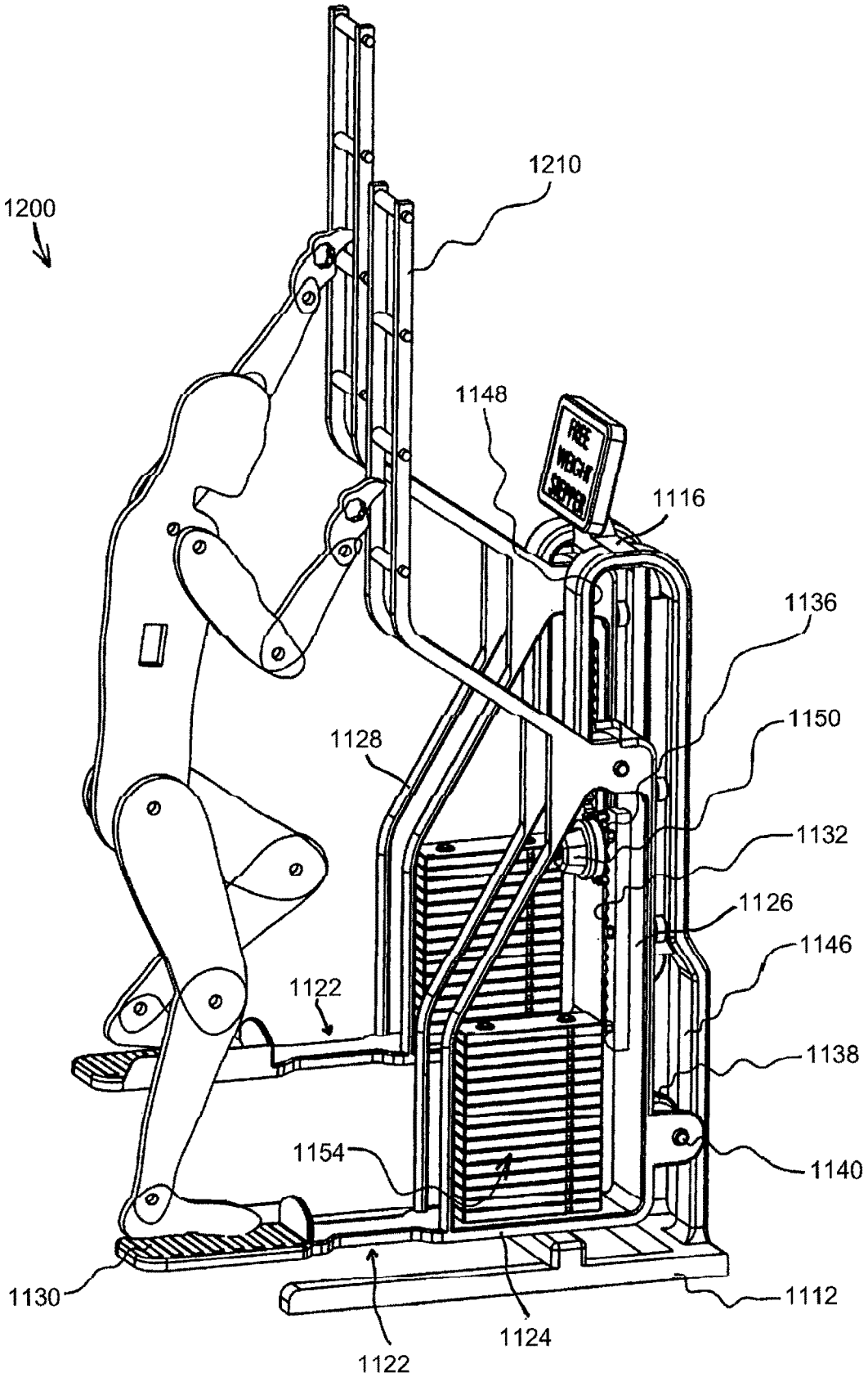
FIG. 13 is a perspective view of a twelfth embodiment of an inertial resistance exercise apparatus.

Directing attention now to FIG. 13, a twelfth embodiment of an exercise apparatus is generally identified by the reference numeral 1200. As noted by the use of common reference numerals, the exercise apparatus 1200 is identical to the exercise apparatus 1100 with the exception that the exercise apparatus 1200 includes handlebars 1210 that enable upper body exercise. The handlebars 1210 may be fixedly connected to the foot support members 1122 and configured for convenient grasping by a user.

Figure 14:
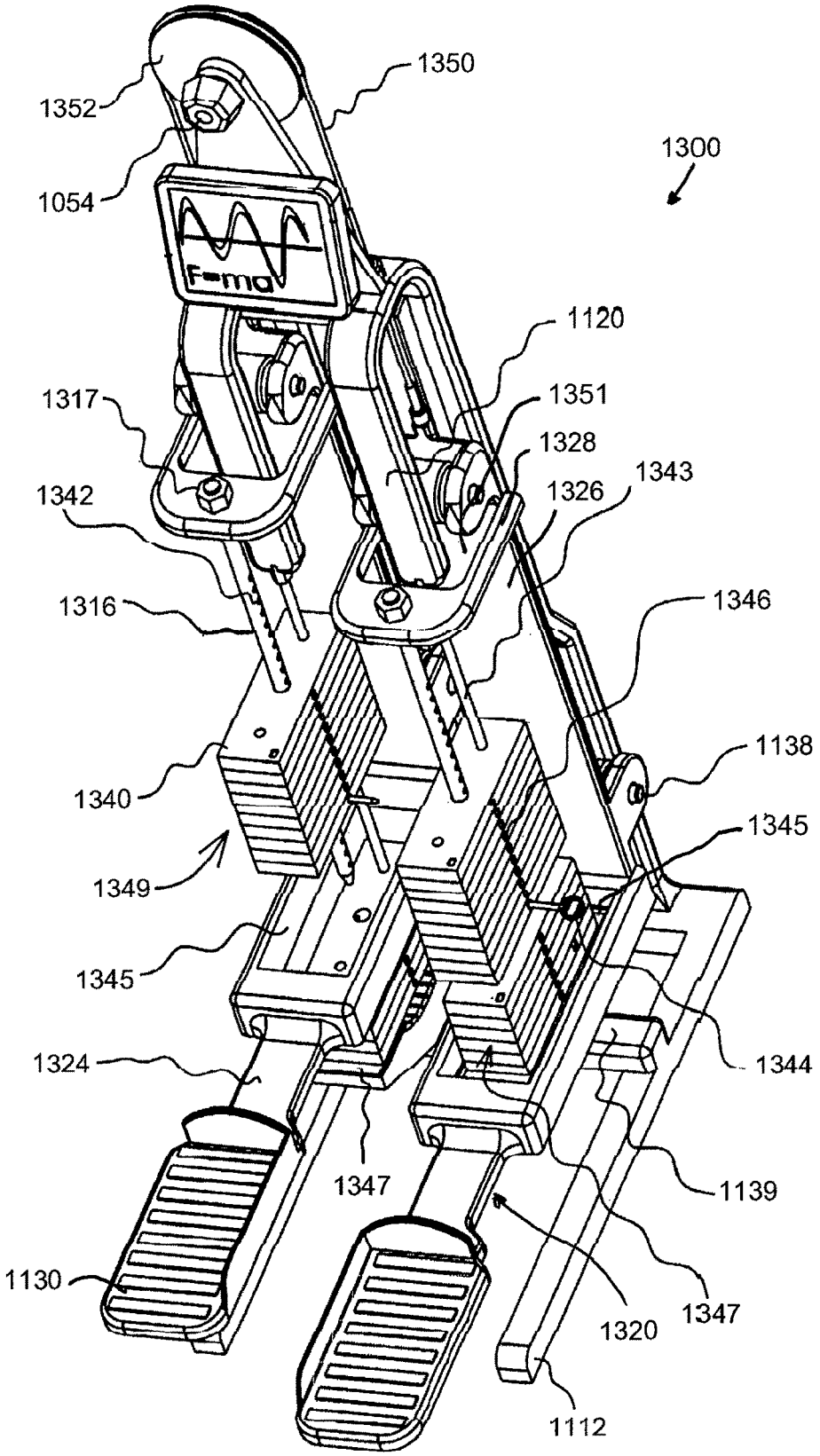
FIG. 14 is a perspective view of a thirteenth embodiment of an inertial resistance exercise apparatus.
Figure 15:
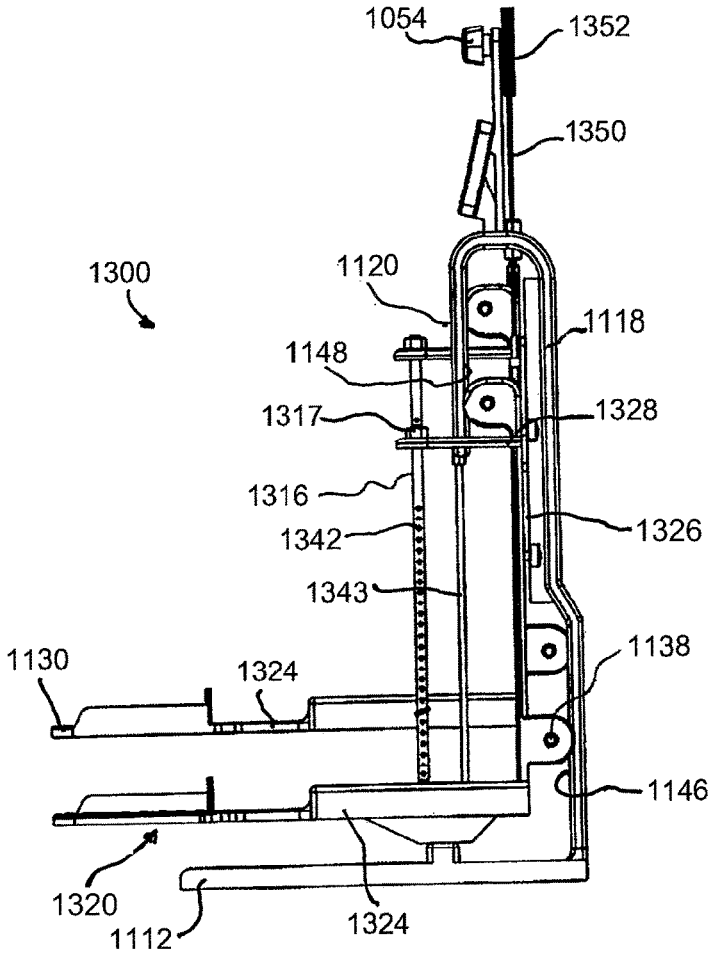
FIG. 15 is side view of the inertial resistance exercise apparatus shown in FIG. 14 without weights.

Directing attention now to FIGS. 14 and 15, a thirteenth embodiment of an exercise apparatus is generally identified by the reference numeral 1300. As noted by the use of common reference numerals, the exercise apparatus 1300 is similar to the exercise apparatus 1100 with a first distinction being that the exercise apparatus 1300 includes a cable 1350 and pulley 1352 arrangement dependently coupling the foot support members 1320. It may be observed that in many instances of the embodiments shown herein, cable and pulley components may be substituted for rack and pinion components, and vice versa. The foot support members 1320 may include a generally horizontally extending leg member 1324, a generally vertically extending leg member 1326, and a generally horizontally extending leg member 1328 which is connected proximate the upper distal end of the vertically extending leg member 1326. The leg member 1328 may be spaced above and parallel to the leg member 1324.

A second distinction of the exercise apparatus 1300 over the exercise apparatus 1100 is that the weight plates 1340 are provided with a central hole for receiving a weight stack selector bar 1316 therethrough. The selector bar 1316 may be rigidly secured to respective leg members 1328 of the foot support members 1320 at a threaded nut 1317. The selector bar 1316 may include a plurality of holes 1342 linearly disposed along the longitudinal direction of the selector bar 1316. A pin 1344 may be received through a pin hole 1346 in each of the weight plates 1340. The pin holes 1346 extend transversally to the longitudinal axis of the weight plates 1340 and may be aligned with one of the plurality of holes 1342 in the selector bar 1316. A user may select the weight to be lifted by inserting the pin 1344 through a pin hole 1346 of the weight plates 1340 into a corresponding hole 1342 in the selector bar 1316. Each of the weight plates 1340 may further include a hole 1341 laterally offset longitudinally from the center of the weight plates 1340 for receipt of a guide bar 1343 therethrough. One end of the guide bar 1343 may be connected proximate the distal end of the front leg member 1120 of the stanchion 1114 and the opposite end thereof connected to the frame 1110. The guide bar 1343 extends downwardly from the front leg member 1120 and through the holes 1341 of the stacked weight plates 1340. The guide bar 1343 constrains the weight plates 1340 rotating about the selector bar 1316 and maintains the aligned stacked relationship of the weight plates 1340.

During operation of the exercise apparatus 1300, the foot support members 1320 travel vertically in a reciprocating motion. The leg members 1324 of the foot support members 1320 may include an opening 1345 so that the leg members 1324 may pass over the stacked weights 1347 while reciprocally lifting and lowering the selected weight stacks 1349.

Figure 16:
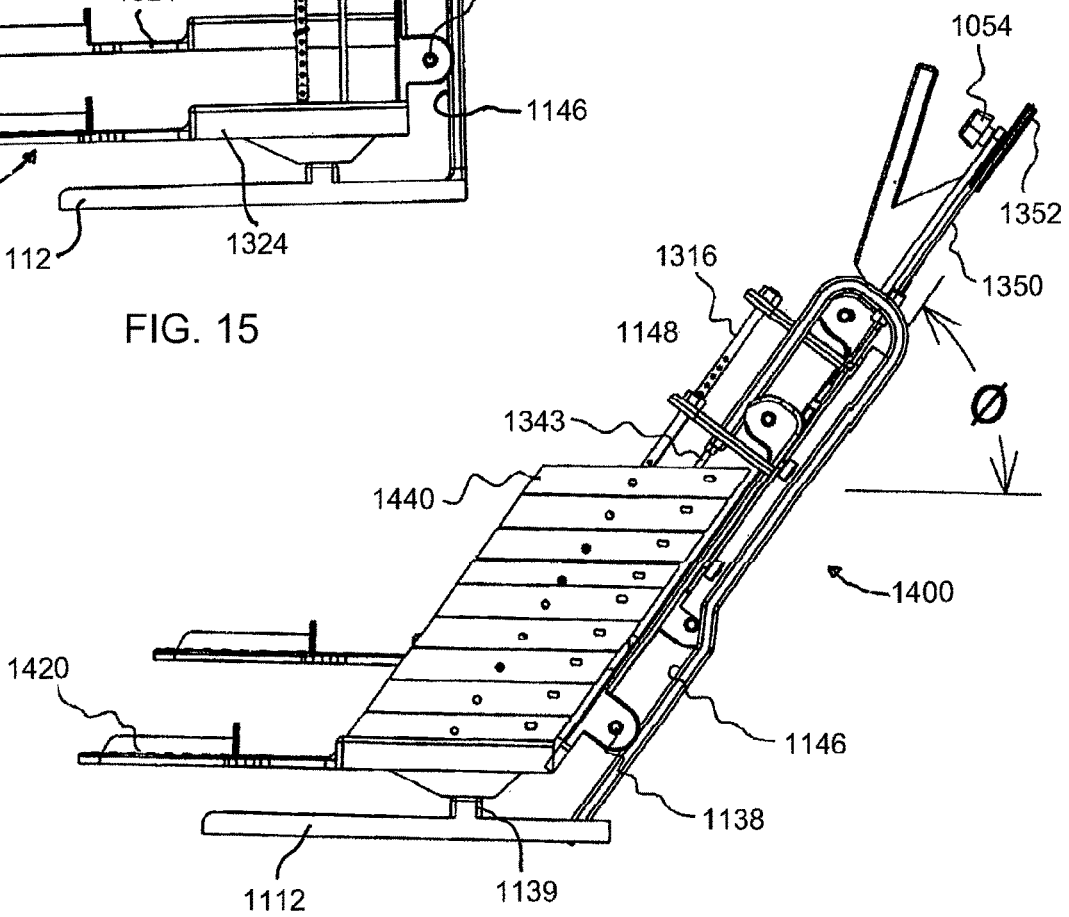
FIG. 16 is a side view of a fourteenth embodiment of an inertial resistance exercise apparatus.

Referring now to FIG. 16, a fourteenth embodiment of an inertial resistance exercise apparatus is generally identified by the reference numeral 1400. As noted by the use of common reference numerals, the exercise apparatus 1400 is similar to the exercise apparatus 1300 with the exception that the weight plates 1440 reciprocate along an inclined plane. Due to the inclined plane, less of the user's weight is available to move the weights 1440 along the inclined plane. In the configuration of the exercise apparatus 1400, the effective user's weight is determined by multiplying the user's weight by the sine of the angle (I). The inertial resistance occurs along the direction of the reciprocating foot support members 1420. The configuration of the exercise apparatus 1400 may result in an inherently slower exercise apparatus for a given unsprung mass M, which may be preferable while operating along an inclined path.

While a preferred embodiment of the invention has been shown and described, other and further embodiments of the invention may be devised without departing from the basic scope thereof, and the scope thereof is determined by the claims which follow.

The invention claimed is:

1. An exercise apparatus comprising:

a) a frame;

b) left and right foot support members movably connected to said frame, said left and right foot support members reciprocally movable along an inclined vertical path;

c) a weight pack supported by each said left and right foot support members; and d) wherein said left and right foot support members and said weight pack define an unsprung mass providing inertial resistance to linear acceleration.

2. The exercise apparatus of claim 1 wherein each said weight pack comprises a plurality of weight plates.

3. The exercise apparatus of claim 2 wherein removal of one or more of said plurality of weight plates decreases said unsprung mass and addition of a weight plate increases said unsprung mass.

4. The exercise apparatus of claim 1 wherein said frame includes left and right races, said left and right foot support members being linearly constrained to move along respective said left and right races.

5. The exercise apparatus of claim 4 including a pinion gear rotatably secured to said frame, each said left and right foot support members including a rigidly secured rack gear in operative engagement with said center pinion gear.

6. The exercise apparatus of claim 1 including a pair of inclined vertically extending guide assemblies spaced apart from one another fixedly secured to said frame.

7. The exercise apparatus of claim 6 wherein said left and right foot support members include linear bearings.

8. The exercise apparatus of claim 1 including left and right guide members fixedly secured to said frame.

9. The exercise apparatus of claim 1 wherein said frame includes a base and a stanchion fixedly secured to said base, said left and right foot support members pivotally connected to said stanchion.

10. The exercise apparatus of claim 1 including a pulley rotatably secured to said frame and a cable looped about said pulley having opposite distal ends fixedly secured to said left and right foot support members.

11. The exercise apparatus of claim 1 including a central bevel gear rotatably secured to said frame, a bevel gear fixedly secured to a forward end of each said left and right foot support members operatively engaged with said central bevel gear.

12. The exercise apparatus of claim 1 wherein said weight packs each comprise two or more separate weight packs supported by each said left and right foot support members.

13. The exercise apparatus of claim 1 wherein said left and right foot support members comprise left and right belt platforms dependently coupled by a rocker member pivotally secured to said frame.

14. The exercise apparatus of claim 1 wherein said frame includes a base and a stanchion fixedly secured to said base, said stanchion including a lower race portion and an upper race portion, said foot support members including lower rollers and upper rollers in rolling contact with respective said lower race portion and said upper race portion of said stanchion.

15. The exercise apparatus of claim 1 including a weight selector bar rigidly secured to said foot support members.

16. An exercise apparatus comprising:

a) a frame;

b) left and right foot support members movably connected to said frame, said left and right foot support members reciprocally movable along an inclined vertical path;

c) first and second weight packs supported by each said left and right foot support members; and d) wherein said left and right foot support members and said first and second weight packs define an unsprung mass providing inertial resistance to linear acceleration.

17. The exercise apparatus of claim 16 further including a cable and pulley system dependently coupling said left and right foot support members.

* * * * *